US005941650A

United States Patent [19]

Fukai et al.

[11] Patent Number: 5,941,650

[45] Date of Patent: Aug. 24, 1999

[54] CAP FOR WRITING INSTRUMENT

[75] Inventors: Akira Fukai; Hideki Takizawa, both of Yokohama, Japan

[73] Assignee: Mitsubishi Pencil Kabushiki Kaisha, Tokyo, Japan

[21] Appl. No.: 09/007,386

[22] Filed: Jan. 15, 1998

[30] Foreign Application Priority Data

Jan. 29, 1997 [JP] Japan ..... 9-029606

[51] Int. Cl.[6] ..... B43K 5/00

[52] U.S. Cl. ..... 401/202; 401/243

[58] Field of Search ..... 401/202, 262, 401/196, 195, 109, 243, 244, 245, 246, 247

[56] References Cited

U.S. PATENT DOCUMENTS 4,273,458 6/1981 Mansheim et al. ..... 401/109

5,316,402 5/1994 Wakai et al. ..... 401/202

*Primary Examiner*—David J. Walczak

*Attorney, Agent, or Firm*—Darby & Darby

[57] ABSTRACT

A cap for a writing instrument has a structure obtained such that a cap main body is formed by injection molding using a plastic material so as to have upper and lower open ends, and a cap head formed separately from the cap main body and integrally having a seal cylinder and clip is mounted on the upper open end of the cap main body.

3 Claims, 8 Drawing Sheets

CAP FOR WRITING INSTRUMENT

BACKGROUND OF THE INVENTION (1) Field of the Invention

The present invention relates to a cap for a writing instrument.

(2) Description of the Prior Art

Conventionally, as shown in FIGS. 1 to 3, there exists a cap for a writing instrument having a structure obtained such that a cap main body 9 is formed by injection molding using a plastic material so as to have upper and lower open ends, and a cap head 10 formed separately from the cap main body 9 and integrally having a seal cylinder 11 and clip 12 is mounted on the upper open end of the cap main body 9, as shown in FIG. 4.

This cap generally has undercuts 13 for engagement with the writing instrument main body at an inner surface portion near the lower open end of the writing instrument main body, as shown in FIG. 2. The undercuts 13 are often formed at a position e (see FIGS. 2 and 3) of the inner wall of the cap main body 9 which opposes a position on an axially extending line of a portion g (see FIGS. 1 and 2) facing the gate of a mold in injection molding, and arbitrary angular positions, e.g., every 90°, from the position e. The undercuts 13 are formed at these positions because drawing design and angular alignment in molding are facilitated.

In injection-molding a plastic using a mold, a weld line is formed on the resultant product. In the conventional cap main body 9, the weld line is formed at the same position of the inner wall as the position e opposing the position on an axially extending line of the portion g facing the gate of the mold. For this reason, the weld line often overlaps the undercut 13.

When the weld line is formed at the position of the undercut 13, and the cap main body 9 is repeatedly attached to or detached from the writing instrument main body, a crack may likely start at the undercut 13 of the cap main body. In particular, when a material such as PET which tends to degrade unless water content management in molding is sufficiently performed is used, this tendency becomes conspicuous. When cracking occurs, the crack becomes noticeable in a transparent material such as PET, although the fitting failure between the cap main body 9 and the writing instrument main body does not occur. Consequently, the product value decreases, and the user feels uncomfortable to use the pen.

SUMMARY OF THE INVENTION

It is an object of the present invention to provide a cap for a writing instrument capable of preventing a crack at an engaging undercut even if the cap is repeatedly attached to or detached from a writing instrument main body.

The present invention has been made to solve the conventional problems described above and has the following aspects.

According to the first aspect of the present invention, a cap for writing instrument comprises:

an inner wall of a cap main body formed by injection-molding a plastic material which has an undercut for engagement with a writing instrument main body at a position circumferentially rotated by an appropriate angle from a position opposing an axially extended line of a portion facing a gate of a mold.

According to the second aspect of the present invention, a cap for writing instrument of the first aspect is characterized in that the engaging undercut comprises four undercuts formed on the inner wall of the cap main body at positions rotated through 45° clockwise and counterclockwise from a position rotated through 180° from a position on the axially extended line of the portion facing the gate of the mold in molding, and at positions further rotated through 90° clockwise and counterclockwise from the positions rotated through 45°.

According to the third aspect of the present invention, a cap for writing instrument of the first aspect is characterized in that the portion facing the gate of the mold is located at an inner edge of a notched portion partially formed at an edge of an upper open end, and the notched portion is closed by a clip of a cap head mounted on the upper open end of the cap main body.

According to the fourth aspect of the present invention, a cap for writing instrument of the first aspect is characterized in that the plastic material essentially consists of PET.

In the cap for the writing instrument according to the present invention, the position of the weld line of the cap main body is displaced from the undercut for engagement with the writing instrument main body. Therefore, a decrease in strength in undercut caused by the weld line can be prevented.

DESCRIPTION OF THE PREFERRED EMBODIMENTS

Figure 1:
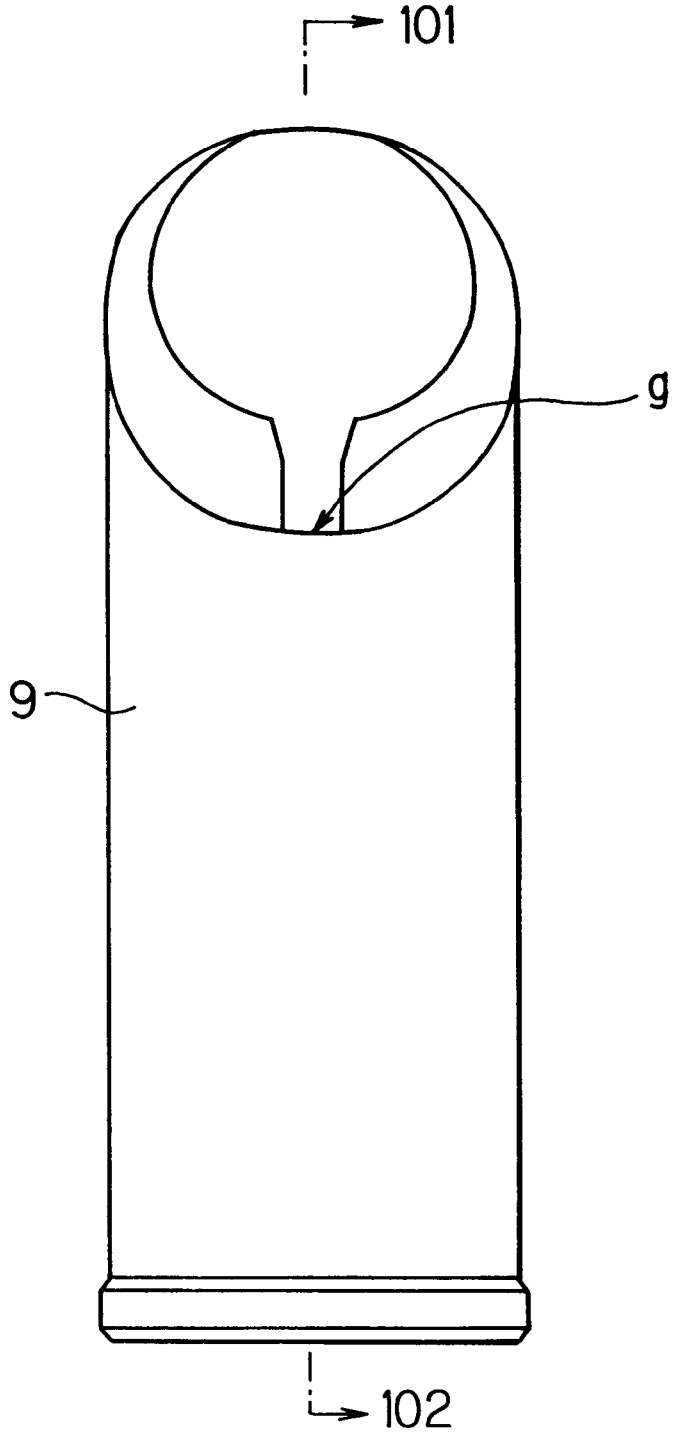
FIG.1 PRIOR ART
FIG. 1 is a side view of a conventional cap main body.
Figure 2:
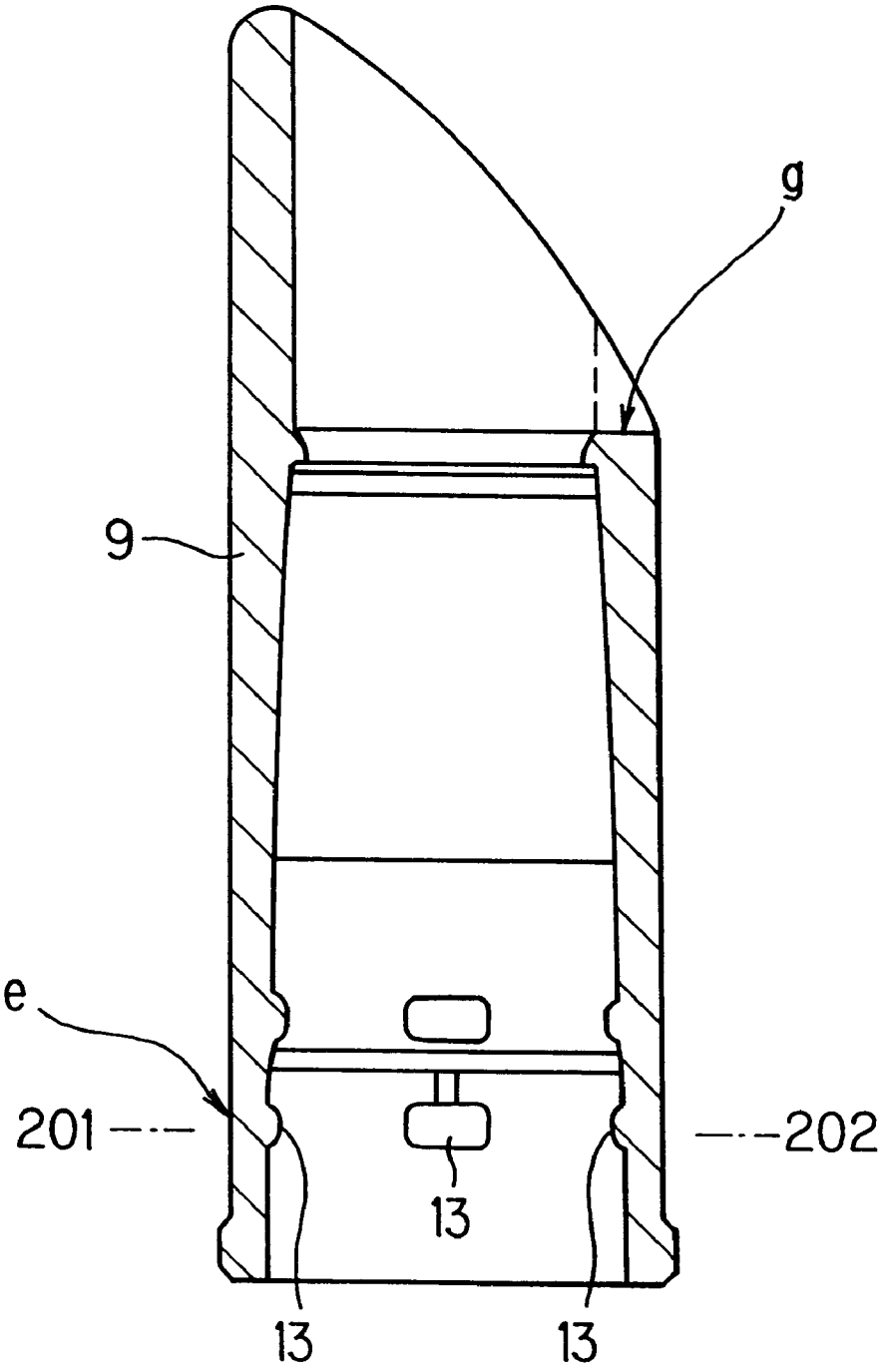
FIG.2 PRIOR ART
FIG. 2 is a sectional view of the cap main body along the line 101–102 in FIG. 1.
Figure 3:
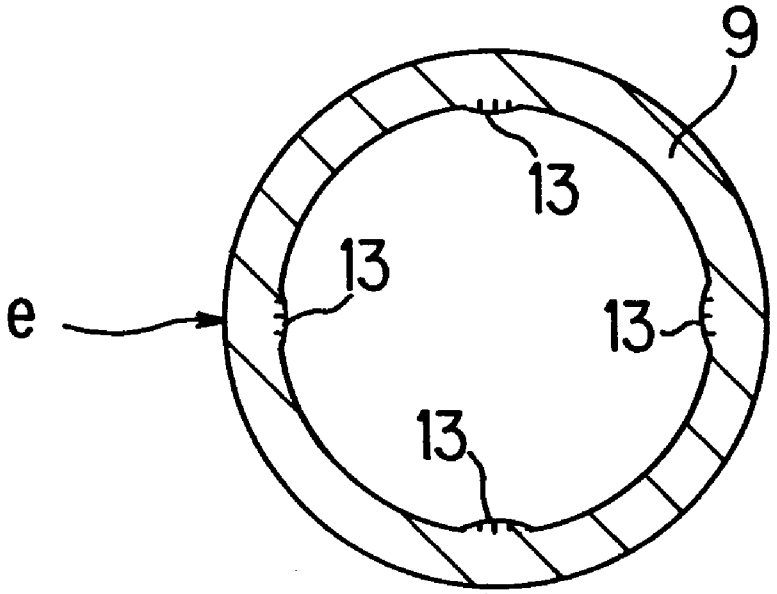
FIG.3 PRIOR ART
FIG. 3 is an end view of the cap main body along the line 201–202 in FIG. 2.
Figure 4:
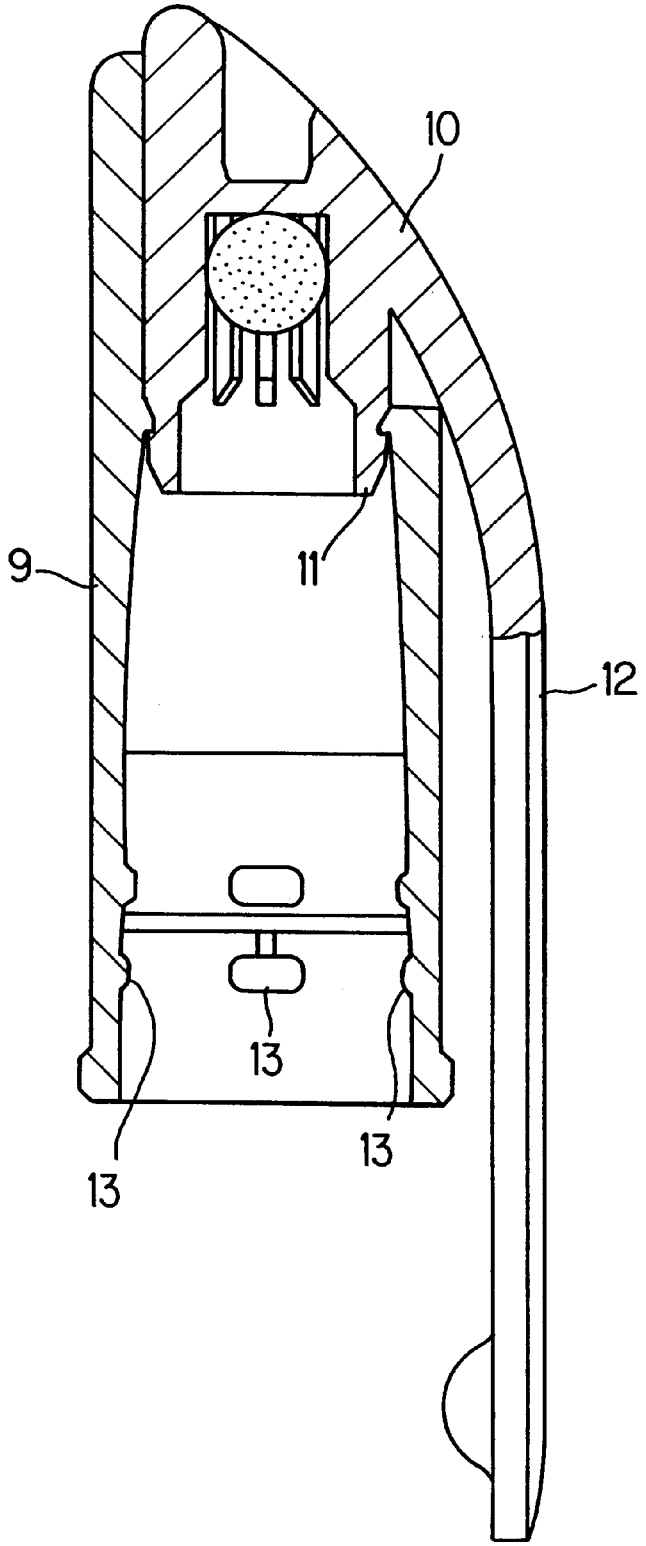
FIG. 4 PRIOR ART
FIG. 4 is an overall sectional view of the conventional cap.
Figure 5:
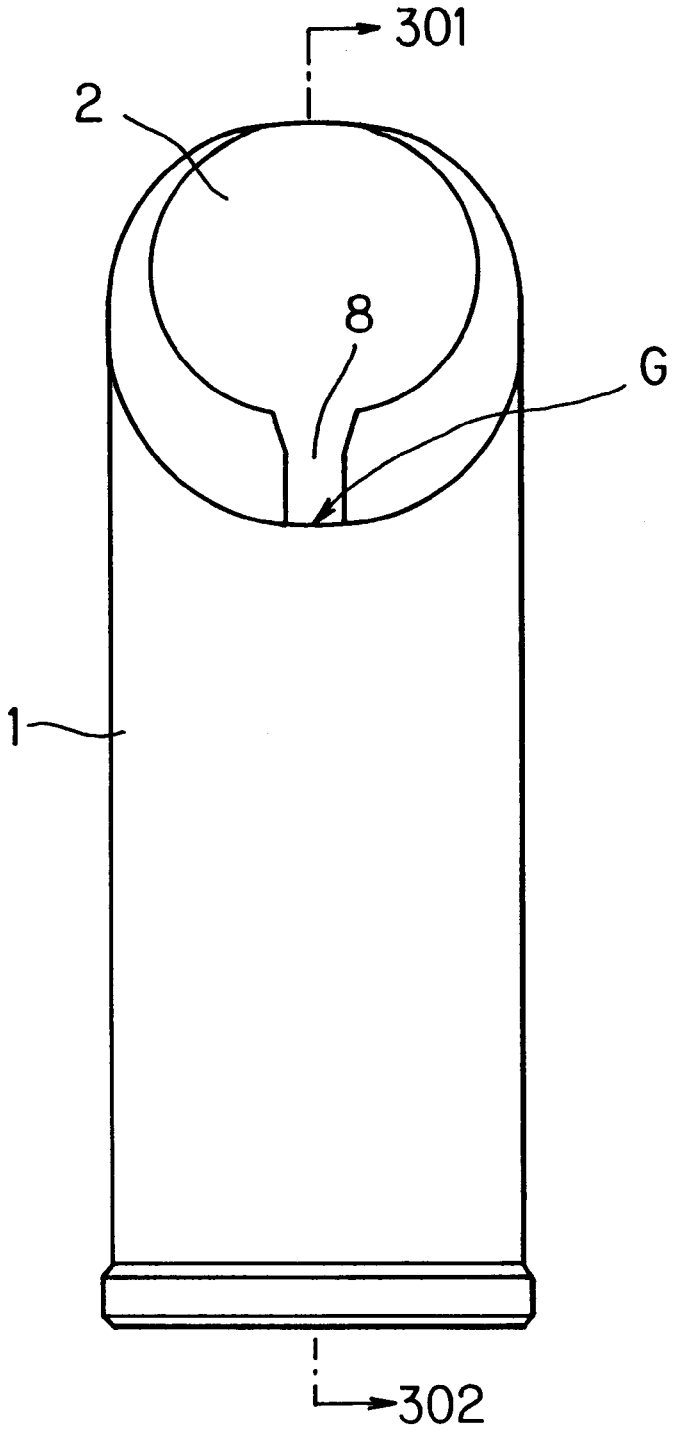
FIG. 5 is a side view of a cap main body according to an embodiment of the present invention.
Figure 6:
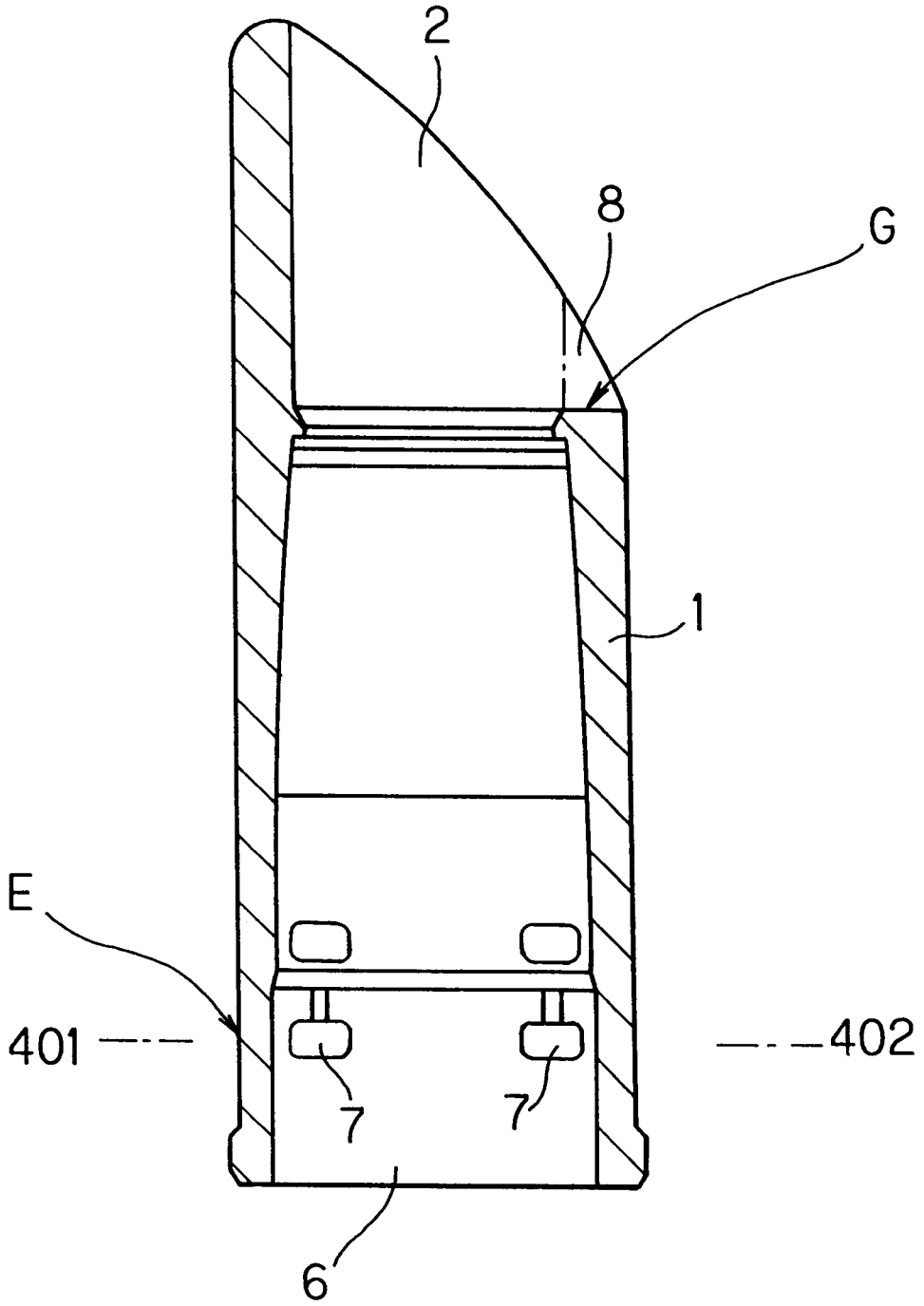
FIG. 6 is a sectional view of the cap main body along the line 301–302 in FIG. 5.
Figure 7:
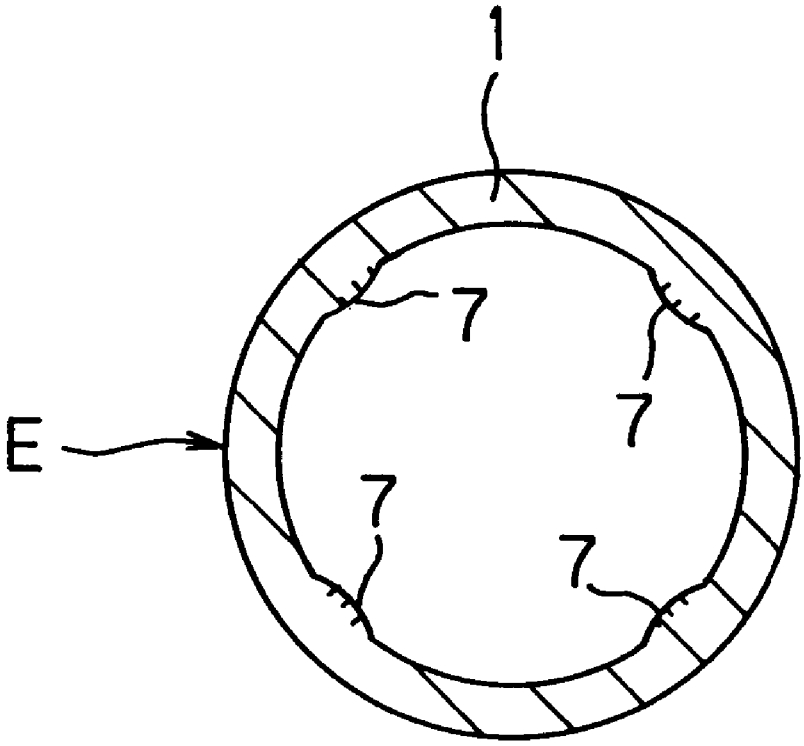
FIG. 7 is an end view of the cap main body along the line 401–402 in FIG. 6.
Figure 8:
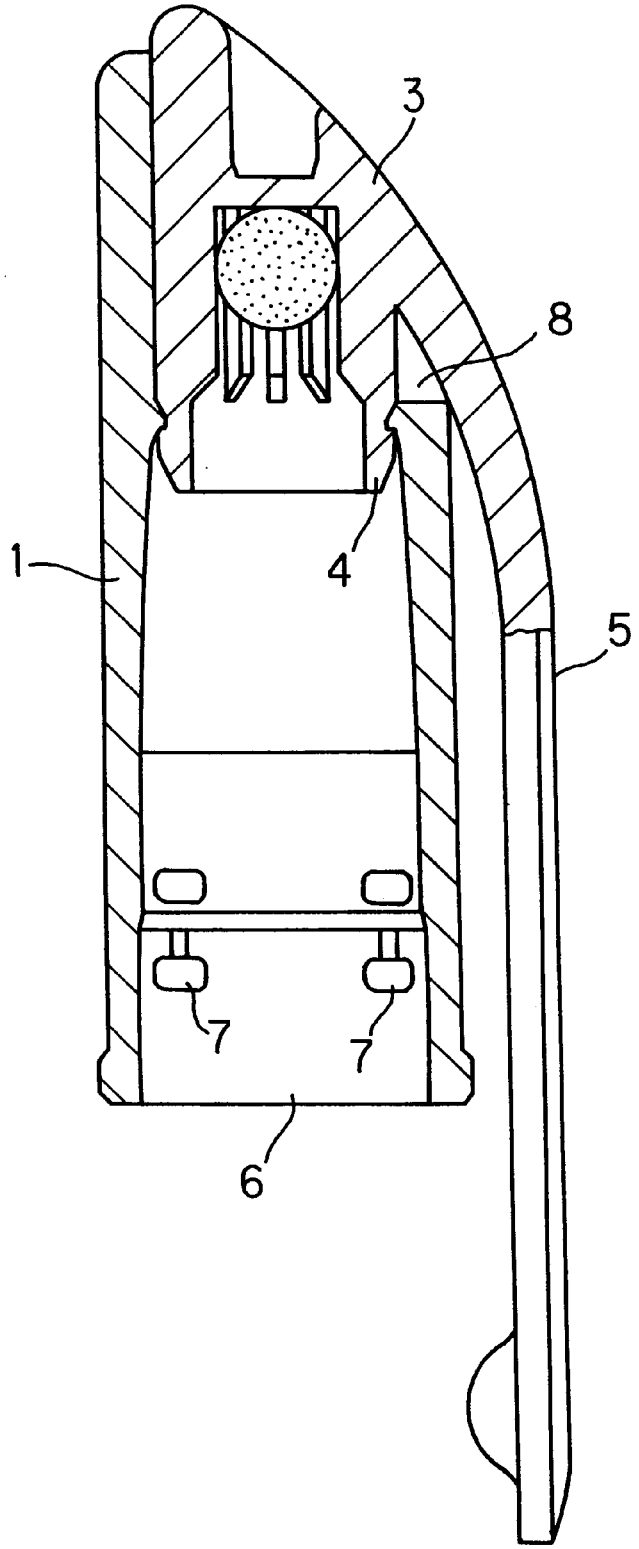
FIG. 8 is an entire sectional view of the cap of the embodiment of the present invention.

An embodiment of the present invention which is illustrated in FIGS. 5 to 8 will be described below. As shown in FIGS. 5 to 7, according to this embodiment, a cap for a writing instrument has a structure obtained such that a cap main body 1 is formed by injection molding using plastic materials such as PET so as to have upper and lower open ends, and a cap head 3 formed separately from the cap main body 1 and integrally having a seal cylinder 4 and clip 5 is mounted on the upper open end of the cap main body 1, as shown in FIG. 8. Undercuts 7 for engagement with a writing instrument main body (not shown) are formed on the inner surface near a lower open end 6 of the cap main body 1.

The four undercuts 7 are formed on the inner wall of the cap main body 1 at positions rotated through 45° clockwise and counterclockwise from a position E (see FIGS. 6 and 7) rotated through 180° from a position on the axially extended line of a portion G (see FIGS. 5 and 6) facing the gate of a mold in molding, and at positions further rotated through 90° clockwise and counterclockwise from the positions rotated through 45°. The mold for molding the cap main body 1 has a structure such that a weld line can be aligned the position E.

As shown in FIG. 5, the portion G facing the gate of the mold is located at an inner edge of a notched portion 8 partially formed at an edge of an upper open end 2, and the notched portion 8 is closed by the clip 5 of the cap head 3 mounted on the upper open end 2 of the cap main body 1.

The cap for the writing instrument of the present invention has the above structure and the position of the undercut 7 for engagement with the writing instrument main body is displaced from that of the weld line. Therefore, decrease in strength of the undercut by the weld line can be prevented. Consequently, even if the cap is repeatedly attached to or detached from the writing instrument main body, start of crack at the undercut 7 can effectively be prevented. Although strict molding conditions are conventionally imposed to prevent cracking, the cap of the present invention can prevent cracking even with slight discrepancies in molding conditions, thereby facilitating molding and reducing the cost.

What is claimed is:

1. A cap for a writing instrument comprises:

a cap main body formed by injection-molding a PET plastic material, the cap main body having an inner wall, a weld line formed in said cap main body along an axially extended line of a portion of the cap main body facing a gate of a mold, and a plurality of undercuts formed on the inner wall for engagement with a writing instrument main body, each undercut circumferentially displaced from the weld line.

2. A cap for a writing instrument according to claim 1 wherein said plurality of undercuts comprises four undercuts formed on said inner wall of said cap main body, two of the four undercuts located at positions rotated through 45° clockwise and 45° counterclockwise respectively from the weld line, and the other two of the four undercuts located at positions rotated through 90° clockwise and 90° counterclockwise respectively from an opposite one of the positions rotated through 45°.

3. A cap for a writing instrument according to claim 1 wherein said weld line is located at an inner edge of a notched portion partially formed at an edge of an upper end of the cap main body, and said notched portion is closed by a clip of a cap head mounted on said upper end of said cap main body.

* * * * *